United States Patent [19]

Sardella

[11] Patent Number: 4,828,244

[45] **Date of Patent: * May 9, 1989**

[54] INTERMITTENTLY PROTRUDING FEEDER FOR PAPERBOARD BLANKS

[75] Inventor: Louis M. Sardella, Towson, Md.

[73] Assignee: Wm. C. Staley Machinery Corporation, Hunt Valley, Md.

[ * ] Notice: The portion of the term of this patent subsequent to Jul. 21, 2004 has been disclaimed.

[21] Appl. No.: 73,285

[22] Filed: Jul. 14, 1987

Related U.S. Application Data

[63] Continuation of Ser. No. 877,582, Jun. 23, 1986, Pat. No. 4,681,311, which is a continuation of Ser. No. 550,285, Nov. 9, 1983, Pat. No. 4,614,335, which is a continuation of Ser. No. 144,129, Apr. 28, 1980.

[51] Int. Cl.[4] ..... B65H 3/64

[52] U.S. Cl. ..... 271/11; 271/35; 271/95; 271/102; 271/112; 271/118

[58] Field of Search ..... 271/10, 11, 34, 35, 271/117, 118, 112, 94, 95, 96, 99, 102, 119

[56] References Cited

U.S. PATENT DOCUMENTS

| | | | |
|---|---|---|---|
| 549,111 | 11/1895 | Crowell . | |
| 976,640 | 11/1910 | Cowles | 271/118 |
| 978,702 | 12/1910 | Cowles | 493/179 |
| 1,092,437 | 4/1914 | Ferguson | 271/118 X |
| 1,572,439 | 2/1926 | La Bombard et al. | 271/118 |
| 2,394,410 | 5/1946 | Tascher | 271/168 |
| 2,819,898 | 8/1954 | Cote | 271/118 X |
| 3,171,647 | 3/1965 | Bishop | 271/94 |
| 3,193,282 | 7/1965 | Stewart | 271/35 X |
| 3,252,702 | 5/1966 | Halbert | 271/94 |
| 3,406,963 | 10/1968 | Goss | 271/118 X |
| 3,486,749 | 12/1969 | Billings | 271/112 |
| 3,525,268 | 8/1970 | Kenny | 74/84 |
| 3,612,512 | 10/1971 | Lang | 271/35 |
| 3,680,855 | 8/1972 | Brown | 271/112 |
| 3,815,900 | 6/1974 | Schulze | 271/118 |
| 3,847,382 | 11/1974 | McKee . | |
| 3,941,372 | 3/1976 | Matsuo | 271/99 X |
| 3,964,740 | 6/1976 | Lamb | 271/112 X |
| 4,015,839 | 4/1977 | McKee | 271/118 X |
| 4,045,015 | 8/1977 | Sardella | 271/112 |
| 4,061,329 | 12/1977 | Sachuk et al. | 271/118 X |
| 4,128,236 | 12/1978 | Lundblad | 271/118 X |
| 4,181,298 | 1/1980 | Capdeboscq | 271/99 |
| 4,219,191 | 8/1980 | Rastorguyeff | 271/35 X |
| 4,232,859 | 11/1980 | Tokuno | 271/35 |
| 4,236,708 | 12/1980 | Matsuo | 271/99 X |
| 4,494,745 | 1/1985 | Ward et al. | 271/95 |
| 4,614,335 | 9/1986 | Sardella | 271/112 |
| 4,681,311 | 7/1987 | Sardella | 271/11 |

FOREIGN PATENT DOCUMENTS

| | | |
|---|---|---|
| 1183100 | 12/1964 | Fed. Rep. of Germany . |
| 1393037 | 5/1964 | France . |
| 2045517 | 2/1971 | France . |
| 2269416 | 11/1975 | France . |
| 839920 | 6/1960 | United Kingdom . |

OTHER PUBLICATIONS

The Rotary Feed; Lou Sardella.

Corrugated Manufactures' Handbook, Third Edition, S&S Corrugated Paper Machinery Company, Inc., 1965, 1965.

*Primary Examiner*—Richard A. Schacher

[57] ABSTRACT

A feeder for paperboard blanks includes a transport, vertical relationship changing structure to alternately provide action and passive positions for the transport, a suction device, and a transmission with input and output shafts operatively connected so that the output shaft undergoes controlled acceleration during an initial portion of each revolution of the input shaft and is stationary during a last portion of each revolution of the input shaft, whereby the transport engages and grips a blank by static friction and moves and accelerates that blank to nip rolls without slippage occurring and so that each blank enters the nip rolls in register whereupon the blank is disengaged from the transport.

4 Claims, 4 Drawing Sheets

INTERMITTENTLY PROTRUDING FEEDER FOR PAPERBOARD BLANKS

This is a continuation of application Ser. No. 877,582, filed June 23, 1986, now U.S. Pat. No. 4,681,311, which in turn is a continuation of application Ser. No. 550,285, filed Nov. 9, 1983, now U.S. Pat. No. 4,614,335, issued 9/30/86, which in turn is a continuation of application Ser. No. 144,129, filed Apr. 28, 1980.

TECHNICAL FIELD

This invention relates to apparatus for feeding paperboard blanks (such as corrugated blanks or sheets) one by one from the bottom of a stack of blanks to nip rolls (usually referred to in the art as feed rolls) for feeding to box-making machinery, such as printing, cutting, slotting, folding, or gluing machinery or the like. Such apparatus is known in the art as a feed table.

BACKGROUND ART

Most commercially available feeders include what is referred to in the art as kicker feed—a pusher member which is reciprocated to engage the trailing end of the blank to be fed, push such blank to the nip rolls, decelerate and come to the end of its stroke and then to return to its initial position to engage the trailing end of the next blank. Kicker feed machines will often jam or misfeed if, among other reasons, a blank is warped or the edge of a blank is crushed or ragged. Such jams necessitate unloading the hopper which causes significant production delays. Moreover, the moving pusher bar, in close proximity to the operator's hands, can be a safety hazard.

One commercially available feeder which does not rely on kicker feed includes a reciprocated suction shuttle member. This machine is described in Bishop et al U.S. Pat. No. 3,105,681. This feeder requires nip rolls which are partially relieved to accommodate the forward position of the shuttle member. Such partially relieved rolls present a deflection problem especially on wide machines. These machines also involve use of a relatively high vacuum (e.g. 10 psi of vacuum), involving a relatively expensive vacuum pump instead of a simple blower. The reciprocation involved in the operation of the Bishop feeder has a tendency to move the blank to be fed away from the gates thereby causing it to be fed out of register.

Another commercially available feeder which does not rely on kicker feed includes partially relieved feed wheels which engage and grip a blank by means of static friction. This machine is described in Sardella U.S. Pat. No. 4,045,015.

SUMMARY OF THE INVENTION

It is an object of this invention to provide novel apparatus which does not have the operating and safety problems of kicker feed and which does not require relieved nip rolls or extremely high degrees of vacuum and which does not have a reciprocated shuttle member and therefore has an advantage in the consistency with which it feeds blanks in register.

It is another object of this invention to provide apparatus which does not require partially relieved feed wheels.

These objects and other objects and advantages are readily obtained by the invention herein as described below.

The apparatus herein is for feeding paperboard blanks one by one from the bottom of a stack of blanks.

The apparatus herein comprises nip rolls, stack supporting structure, transport means, vertical relationship changing means, suction means, transmission means with input shaft means and output shaft means, and means operatively connecting the output shaft means of the transmission means and the transport means.

The stack supporting structure includes a forward portion.

The transport means comprises high coefficient of friction surface which is adapted to be circulated.

The vertical relationship changing means is a means for changing the relative vertical relationship of high coefficient of friction surface of the transport means and the forward portion of the stack supporting structure so as to alternately provide an active position where high coefficient of friction surface extends above the top of the stack supporting structure forward portion and a passive position where high coefficient of friction surface does not extend above the top of the stack supporting structure forward portion.

The suction means is for urging a blank downwardly into engagement with high coefficient of friction surface in the active position.

The transmission means comprises input shaft means which is adapted to be rotated and output shaft means which is adapted to be rotated. The input shaft means and the output shaft means are operatively connected so that the output shaft means undergoes controlled acceleration during an initial period of each revolution of said input shaft means and is stationary during a last portion of each revolution of said input shaft means.

The means operatively connecting the output shaft means of the transmission means and the transport means is adapted so that during the operation of the apparatus, the high coefficient of friction surface is circulated and undergoes controlled acceleration followed by net deceleration followed by a dwell period during which said high coefficient of friction surface is stationary.

The apparatus is such that the active position is effected directly before high coefficient of friction surface undergoes controlled acceleration and the passive position is effected at the conclusion of the controlled acceleration.

In such apparatus, the transport means and in particular high coefficient of friction surface thereof engages and grips the lowermost blank by static friction and moves and accelerates that blank to the nip rolls without slippage occurring and so that each blank enters the nip rolls in register whereupon the blank is disengaged from the transport means.

The combination of the vertical relationship changing means and the transmission means as described above and their interrelation as described above are required herein. Without the vertical relationship changing means functioning to provide active and passive positions when appropriate, high coefficient of friction surface of the transport means would continue to be in engagement with a blank as the high coefficient of friction surface is decelerating and after the blank is being pulled by the nip rolls resulting in the transport means working against the nip rolls. Without a transmission providing controlled acceleration during an initial portion of each revolution of the input shaft, slippage will occur resulting in out of register feed. Without a transmission providing operation whereby the output shaft is stationary during the last portion of each revolution of the input shaft, initial engagement of a blank by the transport means is by sliding friction rather than static friction resulting in slippage and out of register feed.

In preferred apparatus herein, the transport means comprises rotatable feed wheels adapted to coact to frictionally engage and move a blank once the active position has been effected. Each of the feed wheels has high coefficient of friction periphery which constitutes part of the high coefficient of friction surface described above.

Preferred apparatus includes gate means positioned above the stack supporting structure to define an opening and suction means comprising a vacuum box having a vacuum applying surface providing at least part of said forward portion of said stack supporting structure and having openings (e.g. slots) therein for protrusion of feed wheel periphery therethrough to provide said active position. Ordinarily, said vacuum applying surface has a rear edge positioned from about 6 inches to about 30 inches from the opening at the gate means. In such apparatus, the vacuum applying surface preferably is adapted to be moved vertically and the feed wheels are fixed in relation to vertical position and the vertical relationship changing means is adapted to vertically reciprocate said vacuum applying surface to provide an active position where the vacuum applying surface is in a down position and feed wheel periphery protrudes above the vacuum applying surface through openings therein and a passive position where the vacuum applying surface is in an up position and feed wheel periphery doesn't protrude above the vacuum applying surface. In very preferred apparatus of this type, the vertical relationship changing means includes a mounting frame for the vacuum applying surface, cam disc means, cam follower means adapted to track in said cam disc means to vertically reciprocate said mounting frame to vertically reciprocate the vacuum applying surface, and cam shaft means supporting said cam disc means and driven by any machine element running in time with the input shaft means of the transmission means (e.g. the input shaft means itself).

In preferred apparatus herein the characteristics of the transport means and the transmission means and the connections between these are such that a blank being fed is accelerated to enter the nip rolls at the same velocity as the surface of the nip rolls.

The term "register" is used herein to mean that the leading edge of the blank being fed always enters the nip of the nip (feed) rolls at exactly the same point in each machine cycle.

The "opening" defined by the positioning of the gate means is the access between the gate or gates and the structure below through which the lowermost blank is fed as it proceeds to and through the nip rolls. Such opening usually consists of a plurality of openings.

The term "net deceleration" is used herein in relation to high coefficient of friction surface of transport means to means that such surface undergoes motion following the controlled acceleration whereby it comes to be stationary for the dwell period.

The term "transport means" is used herein in a broad sense to include all elements constituting feed elements which are capable of being circulated. The term includes wheel means (including round, ovate or partially relieved wheel means), belts, rolls and the like.

DESCRIPTION OF THE BEST MODE AND OF VARIATIONS

Figure 1:
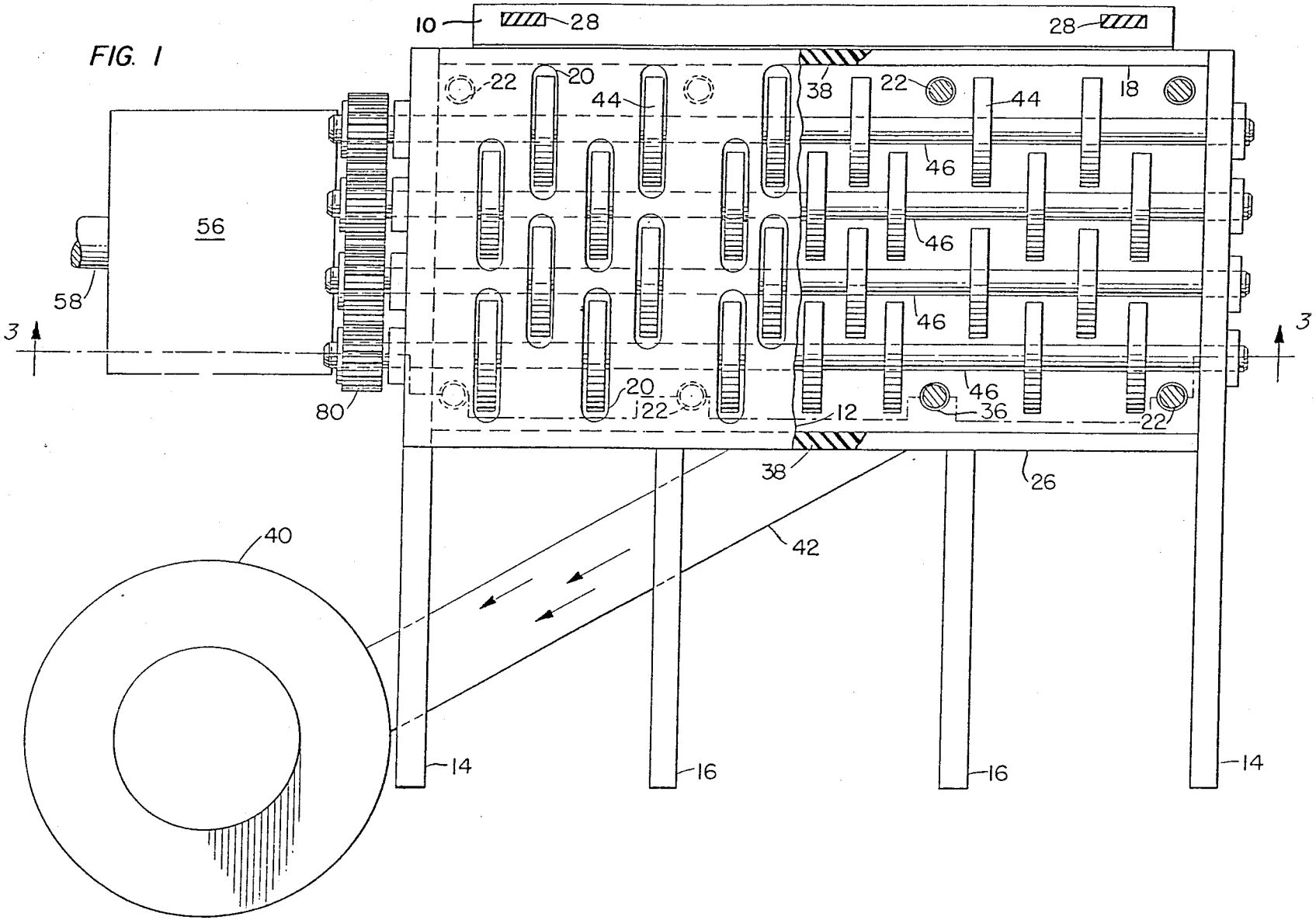
FIG. 1 is a plan view of preferred apparatus within the scope of the invention with a portion broken away to disclose interior details of a construction and other portions left out for simplification purposes.
Figure 2:
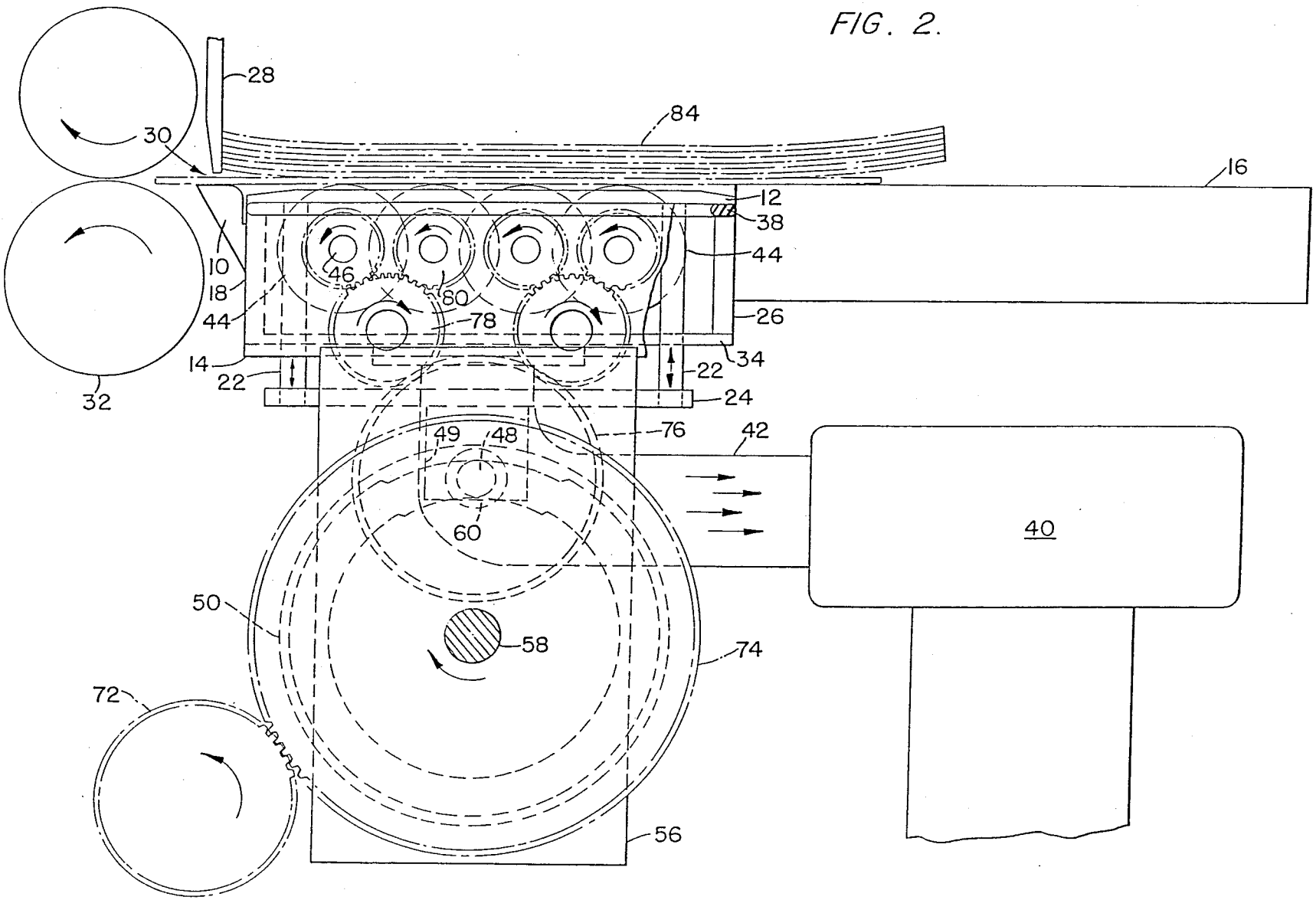
FIG. 2 is a side view of the apparatus of FIG. 1 with a portion broken away to disclose interior details of construction and other portions left out for simplification purposes and additionally depicting a stack of blanks with the lowermost blank being fed.
Figure 3:
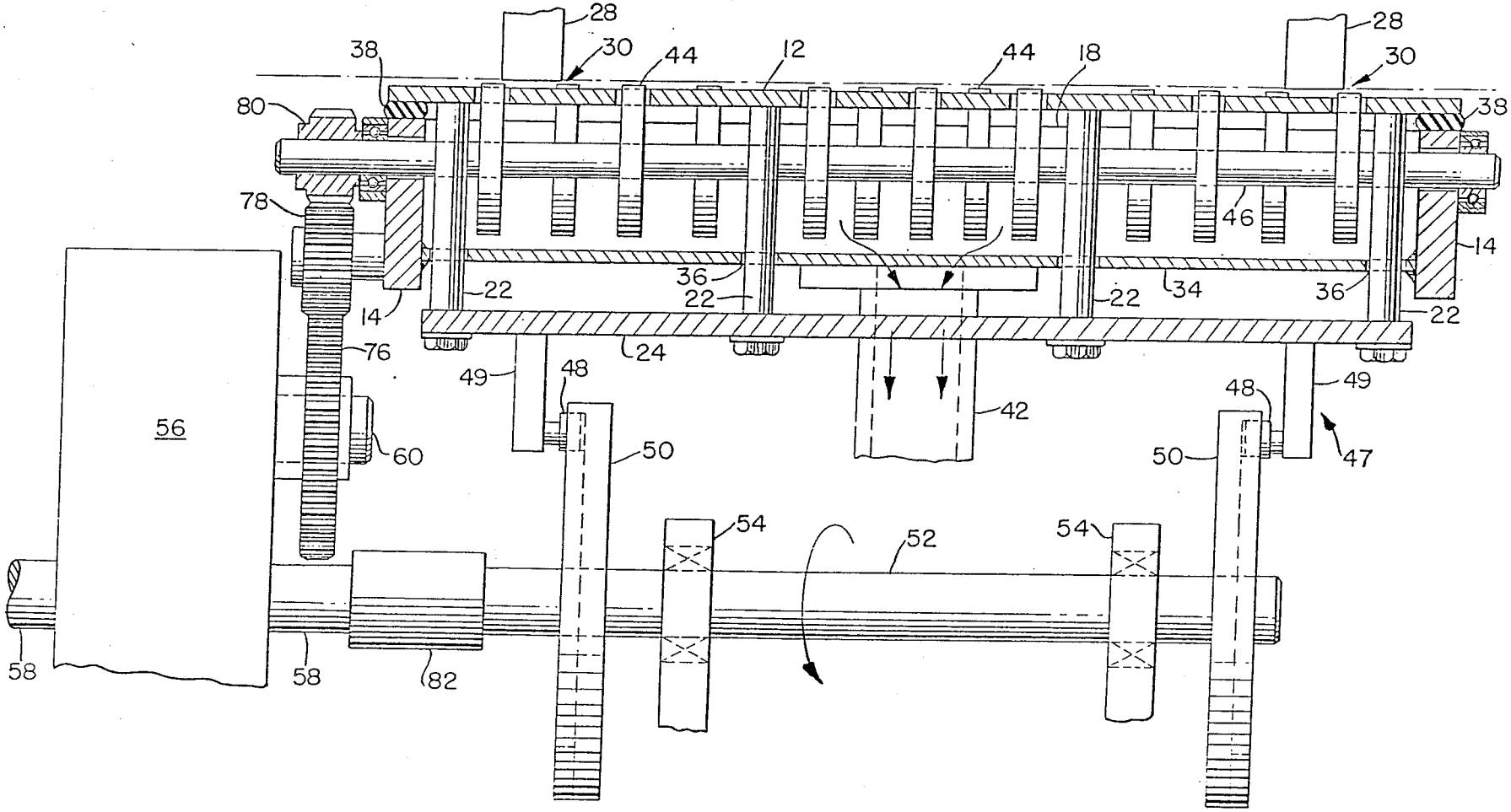
FIG. 3 is a vertical sectional view taken on line 3—3 of FIG. 1.

Continued reference is made to FIGS. 1, 2 and 3 of the drawings.

Stack supporting structure of the depicted apparatus includes a forward portion comprising a threshold 10 and a grill plate 12. Stack supporting structure of the depicted apparatus also includes inboard bars 16 and the rear portions of outboard bars 14.

The threshold 10 is mounted on a forward transversely extending bar 18 which extends between and is fixed to bars 14.

The grill plate 12 includes four sets of slots 20. The slots 20 are elongated in the machine direction. The slots 20 in a set have aligned transverse centerlines. The aligned transverse centerlines of each set are parallel to the aligned transverse centerlines of the other sets and are spaced therefrom. The first and third sets each contain six slots 20 and the second and fourth sets each contain seven slots 20. Each slot 20 in the first set has a longitudinal centerline aligned with a longitudinal centerline of a slot 20 in the third set. Each slot 20 in the second set has a longitudinal centerline aligned with a longitudinal centerline of a slot 20 in the fourth set. Each slot 20 in the second and fourth sets is in staggered relationship with slots 20 in the first and third sets.

The grill plate 12 is fixed to a mounting frame comprising upwardly extending rod members 22 and a rod support plate 24. Grill plate 12 is attached to the top of eight rod members 22 (four along the front of plate 12 and four along the rear of plate 12). The bottom of each rod member 22 is bolted to plate 24. The grill plate mounting frame assembly is movable vertically.

The outboard bars 14 are mounted on frame structure (not depicted).

The inboard bars 16 are fixed to and extend backwardly from a rear transverse member 26 which extends between and is fixed to bars 14.

Gate means in the form of gate members 28 are positioned at the front of the machine above threshold 10 of the stack supporting structure leaving gaps which define an opening in the form of openings 30 through which the blanks are fed. The gate members 28 are adjustable outwardly or inwardly to accommodate the width of the blanks being fed. The gate members 28 are adjustable upwardly and downwardly to adjust openings 30 to accommodate the thickness of a blank being fed. The openings 30 are ordinarily set at 1.5 times the thickness of a blank being fed and might be, for example, 0.25 inches.

Nip rolls (feed rolls) 32 are positioned downstream of the opening in the form of openings 30.

The forward portions of bars 14 together with transversely extending bars 18 and 26 and bottom structure 34 provide the walls and bottom structure for a rectangular cross section vacuum box. The grill plate 12 provides a vacuum applying surface for the vacuum box which is adapted to be vertically reciprocated. The bottom structure 34 contains openings 36 through which the rods 22 pass and which accommodate vertical movement of rods 22. A gasket member 38 is fixed to the top of the vacuum box walls and is adapted to provide sealing between the edges of grill plate 12 and the top of the vacuum box walls when the grill plate is moved up and down. Usually the vacuum applying surface in the form of grill plate 12 terminates about 6 to about 30 inches from (i.e. has a back edge spaced about 6 to about 30 inches from) the opening at the gates.

The vacuum box communicates with a blower 40 (FIGS. 1 and 3) by means of a suitable opening in bottom structure 34 and of appropriate ductwork 42 which is fixed to structure 34 and passes through and accommodates movement of plate 24. The vacuum box, blower and ductwork constitute a suction means for urging the lowermost blank into engagement with high coefficient of friction surface of transport means which is described below. The blower 40 preferably is sufficient to impart a vacuum of 5 to 50 inches of water, very preferably a vacuum of 15 to 35 inches of water, to a blank overlying grill plate 12. A very preferred blower 40 provides a maximum vacuum of 25 inches of water.

Transport means in the form of a plurality of sets of feed wheels 44 are mounted in the vacuum box. The wheels 44 are supported under the vacuum applying surface of the grill plate 12 (i.e. they are mounted on shafts positioned under grill plate 12). Each wheel 44 has a periphery of high coefficient of friction material (e.g. provided by a coating or layer of high coefficient of friction material such as polyurethane, rubber or the like) which provides the high coefficient of friction surface referred to above. Each wheel 44 is adapted to be rotated and is associated with a slot 20 in grill plate 12 and is adapted to protrude through a slot 20 when grill plate 12 has been moved downwardly. There are twenty-six feed wheels 44 on the apparatus, one associated with each slot 20. The feed wheels 44 are mounted on four spaced parallel rotatable shafts 46 which extend transversely (in the cross machine direction) between vacuum box sidewalls provided by-bars 14 with wheels on one shaft being in staggered relationship with the wheels on an adjacent shaft. The feed wheels 44 are adapted to coact to frictionally engage and move the lowermost blank once the active position has been effected.

Means for changing the relative vertical relationship of high coefficient of friction surface (periphery) of the feed wheels 44 and the grill plate 12 comprises the grill plate mounting frame (rod members 22 and rod support plate 24), cam followers 47 comprising rollers 48 mounted on roller shafts supported on follower arms 49, cam discs 50, and cam shaft 52. The follower arms 49 are fixed to plate 24 and the rollers 48 are adapted to track in the cam discs 50 to vertically reciprocate the grill plate 12. The cam shaft 52 supports the cam discs 50. The cam shaft 52 is mounted on bearings 54 and is adapted to be rotated to rotate the cam discs 50 to reciprocate the vacuum applying surface (grill plate 12) by means of cam followers 47 and the grill plate mounting frame (plate 24 and rods 22). The rods 22, plate 34, cam followers 47, cam discs 50 and cam shaft 52 are adapted to alternately provide an active position where the grill plate 12 is in a down position and where feed wheel high coefficient of friction periphery protrudes through slots 20 and extends above the top of grill plate 12 by an appropriate amount (from about 0.03 to about 0.12 inches, preferably from about 0.05 to about 0.07 inches, above the top of grill plate 12) and a passive position where the grill plate 12 is in an up position and where feed wheel high coefficient of friction periphery does not extend above the top of the grill plate 12 (e.g. the tops of the wheels are about 0.03 to about 0.12 inches, preferably about 0.05 to about 0.07 inches, below the top of the grill plate).

The transmission means for the apparatus generally indicated in FIGS. 1–3 by reference numeral 56 is a transmission comprising input shaft means in the form of a shaft 58 which is adapted to be rotated and output shaft means in the form of a shaft 60 (FIG. 3) which is adapted to be rotated with the shafts 58 and 60 operatively connected so that the output shaft means undergoes a controlled acceleration during an initial portion of each revolution of the input shaft means and is stationary during a last portion of each revolution of the input shaft means.

Figure 4:
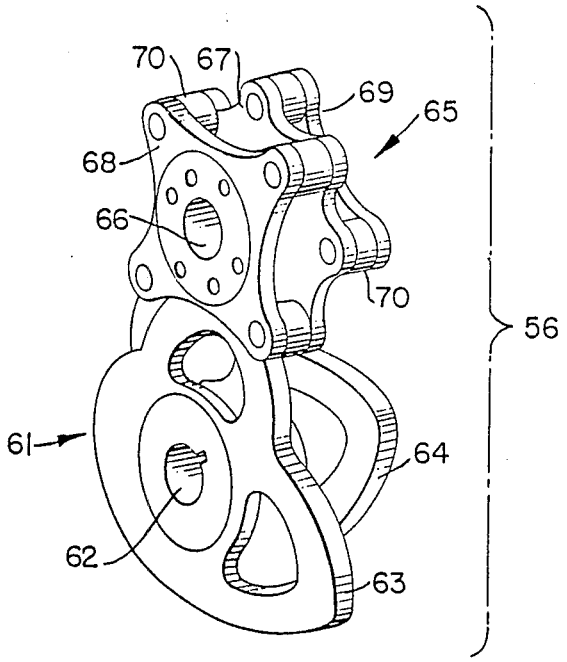
FIG. 4 is a perspective view of a transmission for the apparatus of this invention except for the casing, bearings and shaft.

A very suitable transmission 56 having these characteristics is a parallel shaft index drive which is commercially available from Camco Commercial Division of Emerson Electric Company. A transmission of this type (with casing, bearings and shafts not depicted in order to simplify the depiction) is depicted in FIG. 4. The transmission depicted in FIG. 4 includes conjugate cam 61 having a bore 62 for receiving the input shaft. The cam 61 has peripheral portions 63 and 64 of identical configuration transversely of their axis of rotation and each having lobes displaced relative to each other (so as to impart intermittent or indexing rotation to the output shaft). The transmission of FIG. 4 also includes a cam follower wheel 65 having a bore 66 for receiving an output shaft and comprising a central flange 67 and side flanges 68 and 69. The flange 67 is joined with flanges 68 and 69 by hub portions (not shown). The side flanges 68 and 69 form with central flange 67 yoke portions which support roller shafts on which cam follower rollers 70 are mounted. Rotation of the input shaft 58 rotates the conjugate cam 61 to rotate the cam follower wheel 65 and output shaft 60 to provide the type of motion described above for the output shaft.

The input shaft 58 is driven from the main gear train of the boxmaking machine via transmission input gear 72 and idler gear 74 (See FIG. 2).

The output shaft 60 is operatively connected to the feed wheels 44 and transmits motion to such feed wheels so that during operation of the apparatus the feed wheels 44 are rotated to that the high coefficient of friction surface is rotated and undergoes controlled acceleration followed by net deceleration followed by a dwell period during which the high coefficient of friction surface of the feed wheels is stationary (i.e. the dwell position). The connections between the output shaft 60 and the feed wheels 44 whereby this occurs comprise transmission output gear 76, idler gears 78, feed wheel shaft drive gears 80 and feed wheel shafts 46.

The input shaft 58 is operatively connected by coupling 82 to the vertical relationship changing means (cam shaft 52, cam discs 50, cam followers 47, rod support plate 24 and rods 22) and vertical relationship changing means is designed so that during the operation of said apparatus the active position is effected (grill plate 12 is caused to move to its down position) directly before high coefficient of friction surface undergoes controlled acceleration and so that said passive position is effected (grill plate 12 is moved to its upward position) at the conclusion of said controlled acceleration.

We turn now to operation of the apparatus described above.

A stack of blanks (denoted by reference numeral 84 in FIG. 2) is loaded onto the machine and positioned abutting the rear surface of gates 28. The gates 28 are adjusted vertically so that only a single blank can be fed through opening 30 during each machine cycle (a machine cycle is the period is which an element of the boxmaking machine which is supposed to make one revolution per blank, e.g. a printing cylinder, makes that revolution).

Then feeding is initiated by turning on the power to the boxmaking machine causing blower 40 to operate (whereby the lowermost blank is flattened against the vacuum box) and initiating the driving of gear 72. Gear 72 drives gear 74 which in turn drives input shaft 58. The transmission receives the continuous input from shaft 58. Cam shaft 52 also receives the continuous input from shaft 58—such continuous input is received via coupling 82. The transmission converts the continuous input of shaft 58 into intermittent (indexing) drive and particularly causes output shaft 60 to undergo a controlled acceleration during an initial portion of each revolution of the input shaft, then to undergo deceleration, and finally to stop rotating so that the output shaft 60 is maintained stationary during a last portion of each revolution of input shaft 58. The means operatively connecting output shaft 60 and the feed wheels 44 (gear 76, gears 78, gears 80 and shafts 46) cause the feed wheels 44 and their high coefficient of friction peripheries to be rotated and to undergo controlled acceleration followed by deceleration followed by a dwell period during which the wheels are stationary. Cam shaft 52 drives cam discs 50 which drive cam followers 47 to alternately move the grill plate mounting frame (rod support plate 24 and rods 22) and grill plate 12 up and down. When grill plate 12 is in the down position, an active position is provided whereby periphery of wheels 44 protrudes above the upper surface of grill plate 12 through slots 20. When grill plate 12 is in the up position, a passive position is provided whereby periphery of wheels 44 does not protrude above the upper surface of grill plate 12. Gasket 38 functions to seal the vacuum box sides as grill plate 12 is reciprocated. The coupling 82 functions with the camming mechanism (shaft 52, discs 50 and followers 47) so that the active position (the down position of the grill plate 12) is effected directly before the wheels 44 undergo controlled acceleration whereby the wheels 44 engage and grip the lowermost blank by static friction. The wheels 44 then are accelerated to move and accelerate the blank to nip rolls 32. The diameter of wheels 44, the speed ratio of elements 74, 56, 76 and 80, and the distance of the gates 28 to the nip rolls 32 are selected such that as the blank enters the nip of the rolls 32, the velocity of the blank is approximately the same as the surface velocity of the rolls. The blank is fed to the nip rolls without slippage occurring and enters the nip rolls in register. As the blank is entering the nip rolls, the coupling 82 and camming mechanism actuates the passive position (moves grill plate 12 to its up position) so that the blank is disengaged from wheels 44 and the transmission initiates deceleration and stopping of the feed wheels 44 so they are ready to feed the next blank. FIG. 2 shows feed wheels 44 in active position (grill plate 12 down) and the lowermost blank entering the nip rolls 32.

Figure 5:
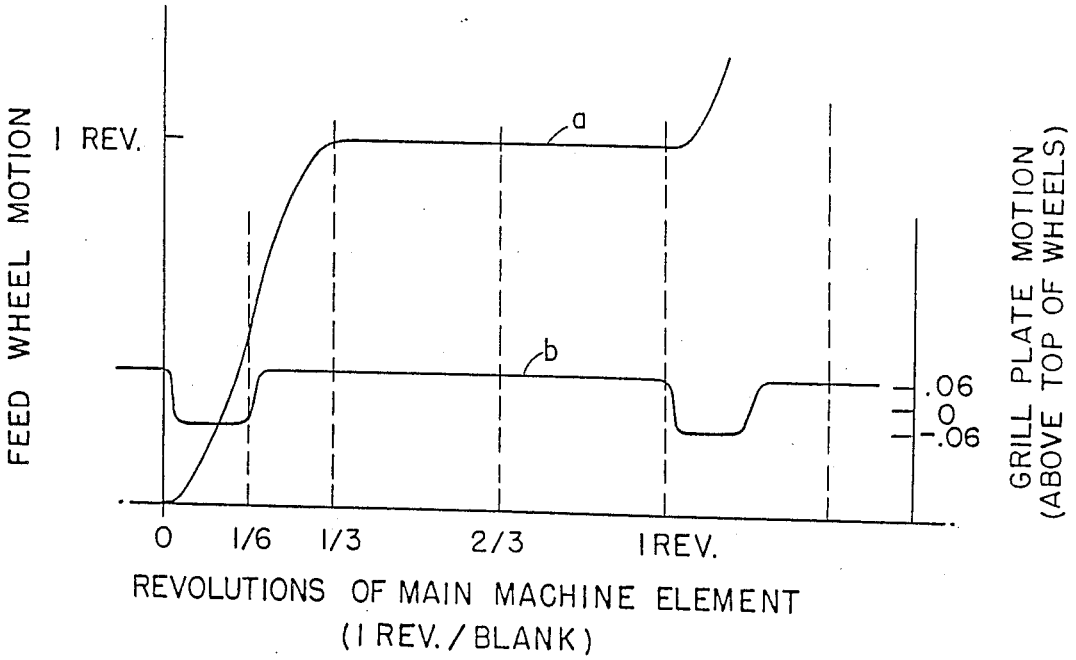
FIG. 5 is a graph illustrating the relationship between revolutions of the main machine element and feed wheel motion and grill plate (vacuum applying surface) motion in a preferred mode of operation of the apparatus of FIGS. 1–3.

A very preferred mode of operation is described in conjunction with FIG. 5 which depicts a very preferred relationship between revolutions of the main machine element (x-axis) and feed wheel motion (left hand y-axis and curve "a") and grill plate motion (right hand y-axis and curve "b"). With reference to the right hand y axis, the figures given are in inches and are the distance of the grill plate from the tops of the feed wheels where plus indicates distance of the grill plate above the top of the wheels (up position for the grill plate—the passive position) and minus indicates distance of the grill plate below the tops of the wheels (down position for the grill plate—the active position). The blanks being fed are 0.16 inches thick and the opening at the gates is 0.25 inches. The cycle arbitrarily begins with the previous blank having cleared the opening at the gates, the wheels 44 in the dwell position (i.e. stationary) and the grill plate 12 is raised (passive) position (0.06 inches above the top of the wheels 44). During the initial part of the cycle, approximately 0–10 degrees, the grill plate 12 is lowered completely (to 0.06 inches below the top of the feed wheels). This coupled with the action of the vacuum box causes the feed wheels to engage and grip the lowermost blank by means of static friction. At this point, the feed wheels are caused to accelerate and they move and accelerate the blank with a controlled acceleration and without slippage occurring so that the blank moves under the gates 28 and through the openings 30 and to the nip of the rolls 32 and is accelerated so that it enters the nip in register and at the same velocity as the velocity of the surface of the nip rolls. At this point, the grill plate 12 is caused to raise (so that it is 0.06 inches above the top of the feed wheels) whereby the passive position is effected and the feed wheels are caused to decelerate. The actuating of the passive position causes the blank to be disengaged from the feed wheels. The feed rolls 32 grip the blank and move it into downstream machinery. With reference to FIG. 5, this operation whereby the feed wheels start at rest in the active position and move and accelerate the blank to the nip of the feed rolls whereupon the passive position is effected and deceleration initiated occurs during the first sixth of a revolution of the main machine element. With further reference to FIG. 5, during the next sixth of a revolution of the main machine element, the grill plate 12 remains to the passive position and the feed wheels undergo controlled deceleration and come to rest. During the last two-thirds of the revolution of the main machine element, the feed wheels are in a dwell position (that is, stationary) and are therefore able to grip the next blank by static friction when the active position is effected at the start of the next cycle. When the blank clears the gates, the cycle begins again.

The invention may be embodied in other specific forms without departing from the essential characteristics thereof.

For example, the camming mechanism which converts circular motion to reciprocating motion to move the grill plate up and down can be replaced with other means normally used for converting circular motion to reciprocating motion, e.g. crank means or the combination of a crank disc and bell crank.

Moreover, the vertical relationship changing means includes means where the grill plate is fixed and other elements, e.g. the feed elements are moved vertically. This can be accomplished by attaching the grill plate to the vacuum enclosure, attaching the cam operated mounting frame not to the grill plate but rather to the wheel shafts 46 through bearing housing, and inserting offset couplings between the drive gears 80 and the wheel shafts which allow the wheel shafts to reciprocate up and down while the drive gears are supported independently of the wheel shafts, and the wheel shafts are supported completely by the cam operated mounting frame and not by the vacuum enclosure. With this arrangement, the relative motion between the grill plate and wheels is the same as for the embodiment depicted in FIGS. 1–3, however, the grill plate is held stationary at a level midway between its travel in operation of the embodiment of FIGS. 1–3 and the wheels are moved above and below this level.

Moreover, the threshold can be reciprocated along with the grill plate.

Moreover, as indicated above, the transport means can be, instead of full wheels, belts or partially relieved wheels or be ovate or have other curvilinear configuration, etc.

Moreover, transmissions other than the one specifically depicted in FIG. 4 are suitable for use in the apparatus of this invention as long as the transmission has input and output shafts which are operatively connected so that the output shaft undergoes a controlled acceleration during an initial portion of each revolution of the input shaft and is stationary during a last portion of each revolution of the input shaft. A very suitable transmission is a right angle index drive available from Camco Commercial Cam Division of Emerson Electric comprising a barrel cam containing ribs defining a groove of serpentine configuration and a circular follower wheel having cam follower bearings which move in the groove along the ribs. Another transmission which is operative is a geneva mechanism; such mechanism supplies the right motion but has the disadvantage of a short life span. While transmission specifically described above provides controlled deceleration of the feed wheels, such deceleration need not be controlled, and the motion involved after the passive position is effected can even be oscillation provided the feed wheels are brought to a stop (dwell period) before the end of the cycle.

Moreover, the feed wheels do not have to make exactly one revolution for each cycle. In other words, a hunting ratio can be provided so that the feed wheels undergo a large number of feed cycles before coming to dwell in exactly the same orientation. This minimizes feed wheel wear.

Moreover, the gears operatively connecting the transmission output shaft with the feed wheels are readily replaced with other machine elements known to those skilled in the art, such as timing belts.

Furthermore, means additional to the vacuum box can be included as an aid to feeding warped blanks such as means to elevate the trailing end of the stack or suction means back of the vacuum box as depicted.

Furthermore, an interrupt or skip feed means can be incorporated in the depicted machine. This feature can be incorporated by including a clutch in the output shaft from the transmission; operation involves declutching during the dwell period.

Furthermore, a metering backstop such as the one described in Hartka U.S. Pat. No. 3,949,980 or other backstops devices can be incorporated to control the stack of blanks.

In view of the variations that are readily understood to come within the limits of the invention, such limits are defined by the scope of the claims.

What is claimed is:

1. Apparatus for feeding corrugated blanks one by one from the bottom of a stack of blanks without slippage and so that the leading edge of the blank being fed always enters the nip of nip rolls at the same point in the machine cycle with precision suitable for printing and slotting, said apparatus comprising a. nip rolls adapted to be operated with a surface velocity;

b. stack supporting structure including a forward portion;

c. transport means supported under said forward portion of stack supporting structure, said transport means comprising a continuous high coefficient of friction surface adapted to be circulated;

d. reciprocating means for changing the relative vertical relationship of said high coefficient of friction surface and said forward portion of said stack supporting structure so as to alternately provide an active position where said high coefficient of friction surface extends above the top of said stack supporting structure forward portion and a passive position where said high coefficient of friction surface does not extend above the top of said stack supporting structure forward portion;

e. suction means for urging a blank downwardly into engagement with said high coefficient of friction surface in the active position;

f. transmission means comprising input shaft means which is adapted to be rotate and output shaft means which is adapted to be rotated;

g. means operatively connecting the output shaft means of the transmission means and the transport means so that during a portion of the operation of the apparatus said high coefficient of friction surface is circulated in a feed direction and undergoes controlled acceleration to said surface velocity;

the apparatus being such that the active position is effected at a time before said high coefficient of friction surface undergoes said controlled acceleration and the passive position is effected at the conclusion of the controlled acceleration; whereby said high coefficient of friction surface of said transport means initiates feeding the lowermost blank in the feed direction by static friction where said high coefficient of friction surface and said blank are in contact at zero velocity and moves and accelerates that blank to the nips rolls without slippage occurring and so that each blank enters the nip rolls in register whereupon the blank is disengaged from the transport means.

2. Apparatus as recited in claim 1 wherein feeding to the nip rolls is carried out only by essentially static friction.

3. Apparatus for feeding corrugated blanks one by one from the bottom of a stack of blanks without slippage and so that the leading edge of the blank being fed always enters the nip of nip rolls at the same point in the machine cycle with precision suitable for printing and slotting, said apparatus comprising:

(a) nip rolls adapted to be operated with a surface velocity;

(b) transport means comprising continuous high coefficient of friction surface adapted to be circulated;

(c) stack support means having a portion including at least one opening to accommodate protrusion therethrough of said friction surface;

(d) reciprocating means for changing the relative vertical relationship of said friction surface and said stack support means portion by moving said stack support means portion or said friction surface relative to one another to intermittently cause said friction surface to protrude through said at least one opening;

(e) suction means for urging a lowermost blank from the stack into engagement with said friction surface;

(f) transmission means operatively connected to said transport means;

(g) means for correlating the operation of elements (a), (b), (c), (d), (e), and (f) so that:

(i) said friction surface is at zero velocity, protrudes through said at least one opening of said stack support means, and is in suction-induced surface-to-surface engagement with the lowermost blank;

(ii) said friction surface is circulated and undergoes controlled acceleration to said surface velocity by element (f) to feed the lowermost blank in the feed direction by essentially static friction, without slippage, and in register to the nip rolls;

(iii) element (d) initiates disengagement between said friction surface and the blank being fed as the nip rolls grip the blank and move the blank to downstream machinery;

(iv) element (d) restores the friction surface protruding through said stack support means relation; and (v) directly before element (f) initiates friction surface circulation in the feed direction, said friction surface is at zero velocity.

4. Apparatus as recited in claim 3 wherein feeding to the nip rolls is carried out by essentially static friction.

* * * * *

UNITED STATES PATENT AND TRADEMARK OFFICE

CERTIFICATE OF CORRECTION

PATENT NO. : 4,828,244

DATED : May 9, 1989

INVENTOR(S) : LOUIS M. SARDELLA

It is certified that error appears in the above-identified patent and that said Letters Patent is hereby corrected as shown below:

Title page:

In the Disclaimer Notice, change " Jul. 21,2004 " to -- Sept. 30,2003 --.

In the Abstract: at line 3, change "action " to -- active --.

Claim 1 (column 10, line 40), change " rotate " to -- rotated --.

Signed and Sealed this

Twentieth Day of February, 1990

*Attest:*

JEFFREY M. SAMUELS

*Attesting Officer* *Acting Commissioner of Patents and Trademarks*